United States Patent [19]

Ritter et al.

[11] Patent Number: 5,039,432

[45] Date of Patent: Aug. 13, 1991

[54] COPOLYMERS OF (METH) ACRYLIC ACID ESTERS AS FLOW IMPROVERS IN OILS

[75] Inventors: Wolfgang Ritter, Haan; Claudia Meyer; Wolfgang Zoellner, both of Duesseldorf; Claus-Peter Herold, Mettmann; Stephan V. Tapavicza, Erkrath, all of Fed. Rep. of Germany

[73] Assignee: Henkel Kommanditgesellschaft auf Aktien, Duesseldorf-Holthausen, Fed. Rep. of Germany

[21] Appl. No.: 320,122

[22] Filed: Mar. 7, 1989

[30] Foreign Application Priority Data

Mar. 7, 1988 [DE] Fed. Rep. of Germany ..... 3807395

[51] Int. Cl.[5] ..... F17D 1/17

[52] U.S. Cl. ..... 252/8.3; 137/13; 252/8.551

[58] Field of Search ..... 252/8.3, 8.551; 137/13

[56] References Cited

U.S. PATENT DOCUMENTS

| | | | |
|---|---|---|---|
| 3,126,260 | 3/1964 | Van der Minne et al. | 44/62 |
| 3,654,994 | 4/1972 | Slagel et al. | 166/308 |
| 3,669,189 | 6/1972 | Fischer | 166/279 |
| 3,726,653 | 4/1973 | Meij et al. | 44/62 |
| 3,735,770 | 5/1973 | Day et al. | 137/13 |
| 3,748,266 | 7/1973 | Malone et al. | 252/8.551 |
| 3,758,406 | 9/1973 | Malone et al. | 252/8.551 |
| 3,854,893 | 12/1974 | Rossi | 44/62 |
| 3,904,385 | 9/1975 | Sweeney | 44/62 |
| 3,926,579 | 12/1975 | Rossi et al. | 44/62 |
| 3,951,929 | 4/1976 | Sweeney | 526/328 |
| 3,957,659 | 5/1976 | Kraats et al. | 252/8.3 |
| 4,045,360 | 8/1977 | Fischer et al. | 252/8.3 |
| 4,068,676 | 1/1978 | Thorn et al. | 137/13 |
| 4,110,283 | 8/1978 | Capelle et al. | 260/23 |
| 4,663,491 | 5/1987 | Barthell et al. | 585/3 |
| 4,983,186 | 1/1991 | Naiman et al. | 137/13 X |

OTHER PUBLICATIONS

Derwent Abstract No. 72-17906T/11.
CAS Abstract No. 76:156516c.
Shellswim-11T, a fluidity improver, Shell Additives, Data Sheet ADD/3/K11.

*Primary Examiner*—Robert L. Stoll
*Assistant Examiner*—Gary L. Geist
*Attorney, Agent, or Firm*—Ernest G. Szoke; Wayne C. Jaeschke; Henry E. Millson, Jr.

[57] ABSTRACT

Method of reducing the pour-point and improving the flowability of petroleum oil or a fraction thereof by adding thereto a flowability-improving quantity of at least one copolymer of (a) an acrylic acid ester, a methacrylic acid ester, or a mixture of an acrylic acid ester and a methacrylic acid ester, and (b) not more than 20% by weight, based on the weight of the copolymer, of acrylic acid, methacrylic acid, or a mixture of acrylic acid and methacrylic acid, and wherein said esters in component (a) are esters of a $C_{16}$ or higher alcohol or an alcohol mixture wherein at least 75% by weight thereof is one or more alcohols containing at least 16 carbon atoms; and the compositions resulting therefrom.

16 Claims, No Drawings

COPOLYMERS OF (METH) ACRYLIC ACID ESTERS AS FLOW IMPROVERS IN OILS

BACKGROUND OF THE INVENTION

1. Field of the Invention

This invention relates to selected copolymers of acrylic and/or methacrylic acid esters as flow improvers in crude petroleum oil and petroleum oil fractions thereof, and to petroleum oil compositions containing them.

2. Statement of Related Art

It is known that the flow properties of crude petroleum oil and/or mineral oil fractions thereof can be improved by using limited quantities of synthetic flow aids with them. As is known, the purpose of these flow aids is the reduction of the actual temperature below which solid components in the liquid hydrocarbon mixture—particularly higher paraffins, in some cases in combination with asphalts or other difficulty soluble components—crystallise out in such quantities that the ability of the hydrocarbon mixture to flow is permanently impaired. The temperatures referred to above are measured by known methods of measuring the pour-point or solidifying point. Each crude oil, or the mineral oil obtained from it, has by reason of its specific composition a characteristic pour-point, which however in many crude oils lies so low that no disadvantageous effect occurs during extraction and pipe-line transport. There are also, however, a whole series of mineral oil grades with a solidifying point above 10 ° C. Here the use of flow aids based on differential synthetic homopolymers and/or copolymers may be advisable. There is extensive prior art with respect to these flow aids, which are also referred to as paraffin inhibitors, and are as a rule produced by the polymerization of olefinically unsaturated compounds, which contain at least partially unbranched saturated hydrocarbon chains with at least 18 carbon atoms. See, for example, U.S. Pat. No. 3,957,659, as well as U.S. Pat. Nos. 4,110,283; 3,904,385; 3,951,929; 3,726,653; 3,854,893; and 3,926,579. See also published German application no. 2 047 448.

In practice, particular difficulties arise when the characteristic pour-point of the crude oil or the mineral oil fractions to be treated reaches extremely high values, e.g. 25 ° C. or even 30 ° C. and over. Mineral oil substances of this type have a tendency toward rapid solidification even at ambient temperature. If, for example, pumping operations are interrupted even for only a short time or if during transport, temperature regions with comparatively low temperatures are crossed—for example by pipes in sea water regions—then there occurs rapid solidification of the hydrocarbon material into a mass which can no longer be pumped, and with it the blocking of pipes, pumps and the like. This problem is made more difficult in that to ensure the absence of solidification of the oil, it is often required in practice to lower the pour-points of the oils and oil fractions to values below 15 ° C. and especially to values below 12 ° C. or even below 10 ° C. It is clear then that technological difficulties arise when for example it is required that a characteristic pour-point of a crude oil of approximately 33 ° C. should drop to values below 10 ° C. As an additional difficulty it should also be noted here that a simple increase of the amount added of any pour-point improver does not in general result in a corresponding increased lowering of the pour-point. Interactions, not explained in detail, between the flow-aids and the solidifying constituents of the crude oil are probably responsible for a type of threshold effect for the intended result, and whereby the particular composition of the flow aid has a decisive influence on its effectiveness. In U.S. Pat. No. 4,663,491 mixed polymerizates are disclosed of n-alkyl-acrylates with at least 16 carbon atoms in the alcohol radical and maleic acid anhydride with molar ratios of n-alkyl-acrylate to maleic acid anhydride of 20 : 1 to 1 : 10. Compounds of this type are disclosed for use as crystallization inhibitors for crude oils containing paraffin. The operating examples therein relate to the use of corresponding copolymers in the molar ratio of acrylic acid ester to the maleic acid anhydride of from 1 : 1 to 8 : 1. Crude oils with characteristic solidifying points below 20 ° C. are predominately used. A table of values is given for India crude oil, which is known to be a particularly highparaffin starting material (disturbing paraffin content 15%) and has a characteristic solidifying point of 33 ° C. The optimal effectiveness of the mixed polymerizates used in this patent with respect to the lowering of the solidifying point of this starting material lies at the molar ratio of acrylic acid ester/maleic acid anhydride of 4 : 1. The lowest solidifying points adjusted here lie at 12 ° C. If the maleic acid anhydride proportion in the copolymerizate is further reduced, the addition of similar amounts results in a rise in the solidifying points of the India crude oil mixed with it, see e.g. Table 2.

DESCRIPTION OF THE INVENTION

Other than in the operating examples, or where otherwise indicated, all numbers expressing quantities of ingredients or reaction conditions used herein are to be understood as modified in all instances by the term "about".

It has now been discovered that polymers of acrylic acid esters and/or methacrylic acid esters of higher alcohols or alcohol cuts having at least 16 carbon atoms, with not more than 20% by weight, based on the weight of the copolymer, of free acrylic and/or methacrylic acids are useful as additives for reducing the pour-point or solidifying point, and for the improvement of the flow properties, particularly in the temperature range just above the solidifying point, in crude petroleum oils and petroleum fractions thereof, especially those oils and fractions thereof that contains significant quantities of paraffin, and sometimes also asphalt.

Particularly suitable co-polymers for use in the practice of the invention contain, together with acrylic and/or methacrylic acid esters of higher alcohols or alcohol cuts, from 0.5% to 15% by weight, preferably from 10% to 10% by weight, and more preferably from 1.5 to 5.0% by weight, based on the weight of the copolymer, of acrylic acid and/or methacrylic acid as comonomer.

The copolymer additives of the invention which reduce the pour-point and improve the flow properties of petroleum oils or oil fractions can be used to advantage with crude petroleum oils or petroleum oil (e.g. mineral oil) fractions of any origin. Their use is particularly helpful in the problem cases described earlier of paraffin-rich crude oils and/or mineral oil fractions with characteristic pour-points of above 20 ° C. and in particular above 25 ° C. By the use of the flow improvers of the invention in only limited quantities it is possible to reduce the pour-point, even in these oils, to values below 15 ° C., and generally to values below 10 ° C. This is even possible when the starting or characteristic pour-point of the oils or oil fractions lies at 30 ° C. or above. According to the invention, it is therefore possible to obtain pour-points in the range of from 0° to 8 ° C., even with extremely paraffin-rich petroleum oils, by the addition of conventional quantities of the flow improvers of the invention. Hence, the problem-free handling of even these crude oils or oil fractions under normal everyday conditions is ensured. In particular, it is ensured that pipes, distributors and the like which are under water can be operated without solidification problems.

Particularly suitable esters of acrylic acid and/or methacrylic acid used in forming the copolymers used in the practice of the invention are those formed with alcohols or alcohol mixtures having a chain length of from $C_{18}$ to $C_{24}$. $C_{18}$ to $C_{24}$ alcohols or alcohol mixtures having predominantly n-alkyl radicals are especially preferred. The alcohols or alcohol mixtures can be of natural or synthetic origin. Most preferred are alcohol mixtures having relatively high contents of alcohols having from $C_{22}$ to $C_{24}$ alkyl radicals therein, e.g. alcohol mixtures containing at least 25 % by weight, preferably at least 35% by weight, more preferably at least 45% by weight, and most preferably at least 50% by weight, of alcohols having from 22 to 24 carbon atoms. The percentages by weight are based on the weight of the alcohol mixture. Alcohols having a chain length of from $C_{25}$ to $C_{30}$ and/or alcohols having a chain length lower than $C_{16}$, e.g. from $C_6$–$C_{15}$ can be present in the alcohol mixtures in quantities of up to about 25% by weight thereof.

The solubility of the copolymers of the invention in common nonpolar solvents, such as toluene and the like, is enhanced by the use of the relatively long chain alcohols used in forming the acrylic and/or methacrylic acid esters used for copolymerization with the corresponding free acids.

The copolymers of the invention which contain acrylic acid as the free acid component thereof are preferred. Also, copolymers wherein the ester component is an ester of acrylic acid, and the free acid component is acrylic acid, are especially preferred.

The copolymers of the invention are added to petroleum oil or mineral oil in a quantity of from 20 to 1000 ppm, preferably in a quantity of from 100 to 500 ppm. These quantities are conventional for pour point improving additives. The copolymers of the invention are usually added in the form of a solution or dispersion in a nonpolar solvent, e.g., toluene.

The procedure for preparing the copolymers used in the practice of the invention is set forth in the following examples. The procedure used is similar to that disclosed in U.S. Pat. No. 4,663,491 for the preparation of other copolymers. The following examples are given for illustration purposes only and not for purposes of limitation.

EXAMPLES

For the production of the acrylic acid co-polymerizate the two acrylate ester mixtures A and B are used, which differ in the C-chain distribution of the fatty alcohol mixtures used in each case for the acrylic acid esterification. The composition of two acrylate types are given in Table I below:

TABLE 1

| | C-Chain distribution of the fatty alcohols/% | | | | | |
|---|---|---|---|---|---|---|
| | $C_{16}$ | $C_{18}$ | $C_{20}$ | $C_{22}$ | | |
| Acrylate A | 16.3 | 22.9 | 10.7 | 46.9 | | |
| Acrylate B | | 1.5 | | 8.6 | 15.2 | 68.8 |

The total percentages given above do not add up to 100% due to the presence of small quantities of alcohols of other chain lengths present therein.

For the production of the acrylate/acrylic acid copolymers two process types were used, the batch process and the in-flow process.

EXPERIMENTAL EXECUTION OF THE BATCH PROCESS

The monomers, initiators, and solvents were weighed in a three-necked flask.

The charge was evacuated for 10×1 minutes with a stirrer rotation rate of 70 r.p.m. and the vacuum each time was released with 99.999% nitrogen. At a stirrer rotation rate of 50 r.p.m. and with light $N_2$ flow the mixture was heated to 90° C. and kept at this temperature. During the whole reaction, the work was carried out under inert conditions. The commencement of the reaction was indicated by a temperature increase to 93 to 96 ° C. The charge was kept for 3 hours at 90 ° C. ±1 ° C. After this time it was cooled over 45 minutes to ambient temperature and the product was drawn off.

Here and in the in-flow process below, toluene was used as the solvent. The polymerization initiator used was dibenzoylperoxide or azoisobutyronitrile. The mixture ratio of solvent to monomer mixture was 1 : 1 (parts by weight).

EXPERIMENTAL EXECUTION OF THE IN-FLOW PROCESS

The monomers were dissolved in toluene in a mixture ratio of 1 at 45 to 50 ° C and the solution was then cooled to 25 ° C. The initiator was also used dissolved in toluene. Approximately 20% of the monomer solution per batch was placed in a reactor. The reactor was rinsed three times with nitrogen and heated to 90 ° C. with light $N_2$ flow with stirring. The initiator solution was then added in such quantities that the total addition time amounted to 2.5 hours.

Approximately 20 minutes after beginning the addition of the initiator a temperature increase occured. The temperature was kept at 90°±3 ° C. by cooling the reactor jacket.

30 Minutes after beginning the addition of the initiator the remaining monomer solution was added in such doses to the reactor that the total addition time amounted to 2 hours. During the entire reaction time the temperature was kept at 90°±3 ° C. Following this the reaction mixture was kept for a further 60 minutes at the same temperature. Then the reaction product was cooled and drawn off at 30 ° C.

In the following Table 2, Examples 1 to 11 according to the invention, and Example 12, having a free acid content higher than the copolymers of the invention, are summarized. Table 2 shows the type of acrylate monomer A or B for the respective Example and the percentage content (% by weight) of the acrylic acid in the monomer mixture for the production of the pour-point reducer. In Example the flow improver was produced according to the batch process 1 and in Examples 2 to 12 it was produced according to the in-flow process.

As initiator, azoisobutyronitrile was used in examples 1 to 7 and in all other examples dibenzoylperoxide was used.

Table 2 also gives the specific viscosity of the respectively produced copolymer solutions. The viscosity measurement was carried out using a Ubbelohde-viscosimeter, capillary I, diameter 0.63 mm. The toluene solutions measured were 3% solutions. The measurement was carried out at 20 ° C. after a temperature equalization of 10 minutes.

The pour-point values are set forth in Table 2, which were obtained by the addition of the pour-point improver according to the invention to the India-Crude (Bombay Crude oil) according to the following process.

DETERMINATION OF THE POUR-POINT

The pour-point was determined as follows, according to ASTM D 97-66 or DIN 51597 :

25.0 g Bombay crude oil together with 800 ppm of a 50% by weight solution of the flow improver were held in a closed vessel for 15 minutes at 50 ° C. and then shaken strongly 5 times at regular intervals. The crude oil thus doped was quickly decanted into a cylindrical glass vessel with an inside diameter of 27 mm and after being closed immediately, this vessel was hung at a sufficient depth in a water bath at +36 ° C.

After 30 minutes the glass was tilted slightly to one side to see whether or not the contents were fluid. The sample was then cooled in stages of 3 ° C and the test procedure was carried out each time. At the temperature at which the contents no longer flowed even when the test glass was tilted to 90 °, 3 ° C. was added and this temperature was taken as the pour-point.

The pour point of the untreated Bombay crude oil according to this method of determination was 30 ° C.

TABLE 2

| Example | Acrylate type | % Weight acrylic acid in copolymer | Specific Viscosity | Pour-point in Bombay-crude-oil (°C.) |
|---|---|---|---|---|
| 1 | A | 2.5 | 0.54 | 6 |
| 2 | A | 1.25 | 0.74 | 12 |
| 3 | B | 1.25 | 0.69 | 9 |
| 4 | A | 2.5 | 0.93 | 6 |
| 5 | A | 2.5 | 0.54 | 6 |
| 6 | B | 2.5 | 0.73 | 6 |
| 7 | A | 2.5 | 1.1 | 9 |
| 8 | A | 5 | 0.61 | 12 |
| 9 | B | 5 | 0.58 | 6 |
| 10 | A | 10 | 0.64 | 12 |
| 11 | A | 20 | 0.37 | 21 |
| 12 | A | 40 | 0.30 | 24 |

In a further investigation the determination of the flow limits was carried out according to Example 6 by means of a rotation viscosimeter CS 100 from Carri-Med Ltd. In the same way the corresponding effect of a commercial trade product based on the copolymerization of a long-chain acrylate and pyridine was determined. Details of this test are given below:

10.0 g Bombay crude oil, doped with a) 300 ppm of 50 % of a flow improver according to example 6 and in a second test with b) 300 ppm of a 50 % flow improver known and used in practice, was cooled for 2 hours to 6° C. and then the flow limits were determined with the following results:

| | According to the invention | Commercial Product (Shellswim-11T) |
|---|---|---|
| Flow limits after 2 hours at 60° C. in $N \cdot m^{-2}$ | 37 | 1769 |

When the doped crude oil was kept for 72 instead of 2 hours at 6 ° C., then the flow limit amounted to 99 $N \cdot m^{-2}$ with the flow improver according to the invention and 1990 $N \cdot m^{-2}$ with the commercial product.

The technical advantages of the flow improvers according to the invention can be seen from the above tests. The pump pressure which must be applied to operate a pipe-line filled with cooled crude oil containing the commercial product, after 2 hours cooling time, amounted to 48 times the pressure, and after 72 hours cooling time, to 20 times the pressure required for similarly cooled crude oil containing the flow improver of the invention.

We claim:

1. A petroleum oil or fraction thereof containing a flowability-improving quantity of at least one copolymer consisting of (a) an acrylic acid ester, a methacrylic acid ester, or a mixture of an acrylic acid ester and a methacrylic acid ester and (b) from about 0.5% to 20% by weight, based on the weight of the copolymer, of acrylic acid, methacrylic acid, or a mixture of acrylic acid and methacrylic acid; and wherein said esters in component (a) are esters of a $C_{16}$ or higher alcohol or an alcohol mixture wherein at least 75% by weight thereof is one or more alcohols containing at least 16 carbon atoms, and the petroleum oil or fraction thereof without the copolymer has a pour-point above 20° C.

2. The petroleum oil or fraction thereof of claim 1 wherein such oil or oil fraction contains paraffin.

3. The petroleum oil or fraction thereof claim 2 wherein such oil or oil fraction also contains asphalt.

4. The petroleum oil or fraction thereof of claim 1 wherein the flowability—improving quantity is from about 20 to about 1000 ppm.

5. The petroleum oil or fraction thereof of claim 4 wherein said quantity is from about 100 to about 500 ppm.

6. The petroleum oil or fraction thereof of claim 1 wherein said esters in component (a) are esters of alcohols having predominatly N-alkyl radicals.

7. The petroleum oil or fraction thereof of claim 1 wherein the at least one copolymer contains from about 0.5 to about 15% by weight of acrylic acid and/or methacrylic acid as comonomer.

8. The petroleum oil or fraction thereof of claim 1 wherein the at least one copolymer contains from about 1 to about 10 % by weight of acrylic acid and/or methacrylic acid as comonomer.

9. The petroleum oil or fraction thereof of claim 8 wherein the at least one copolymer contains from about 1.5 to about 5.0% by weight of acrylic acid and/or methacrylic acid as comonomer.

10. The petroleum oil or fraction thereof of claim 1 wherein said esters in component (a) are esters of a $C_{18}$ to $C_{24}$ alcohol or an alcohol mixture containing predominantly one or more $C_{18}$ to $C_{24}$ alcohols.

11. The petroleum oil or fraction thereof of claim 10 wherein said esters are esters of alcohols having predominately n-alkyl radicals.

12. The petroleum oil or fraction thereof of claim 10 wherein said esters are ester of a $C_{22}$ to $C_{24}$ alcohol or an alcohol mixture containing predominately one or more $C_{22}$ to $C_{24}$ alcohols.

13. A method of improving the flowability and reducing the pour-point of a petroleum oil or fraction thereof having a pour-point above 20° C. comprising adding thereto a flowability-improving and pour-point reducing quantity of at least one copolymer consisting of (a) an acrylic acid ester, a methacrylic acid ester, or a mixture of an acrylic acid ester and a methacrylic acid ester, and b) from about 0.5% to 20% by weight, based on the weight of the copolymer, of acrylic acid, methacrylic acid, or a mixture of acrylic acid and methacrylic acid, and wherein said esters in component (a) are esters of a $C_{16}$ or higher alcohol or an alcohol mixture wherein at least 75% by weight thereof is one or more alcohols containing at least 16 carbon atoms.

14. The method of claim 13 wherein said quantity is from about 20 to about 1000 ppm.

15. The method of claim 13 wherein said quantity is from about 100 to about 500 ppm.

16. The method of claim 13 wherein the petroleum oil or fraction thereof contains paraffin.

* * * * *